US010533402B2

(12) United States Patent
de Jong et al.

(10) Patent No.: US 10,533,402 B2
(45) Date of Patent: Jan. 14, 2020

(54) ACTIVE ORIENTATION OF A REFERENCE WELLBORE ISOLATION DEVICE

(71) Applicant: Halliburton Energy Services, Inc., Houston, TX (US)

(72) Inventors: Michael Anthony de Jong, Balikpapan (ID); Clinton Carter Quattlebaum, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 101 days.

(21) Appl. No.: 15/031,496

(22) PCT Filed: Jun. 30, 2015

(86) PCT No.: PCT/US2015/038636
§ 371 (c)(1),
(2) Date: Apr. 22, 2016

(87) PCT Pub. No.: WO2017/003465
PCT Pub. Date: Jan. 5, 2017

(65) Prior Publication Data
US 2017/0167235 A1 Jun. 15, 2017

(51) Int. Cl.
*E21B 43/11* (2006.01)
*E21B 43/119* (2006.01)
(Continued)

(52) U.S. Cl.
CPC ..... *E21B 43/119* (2013.01); *E21B 23/06* (2013.01); *E21B 33/12* (2013.01); *E21B 47/09* (2013.01)

(58) Field of Classification Search
CPC ..... E21B 23/06; E21B 33/12; E21B 47/09; E21B 43/11; E21B 43/119
See application file for complete search history.

(56) References Cited

U.S. PATENT DOCUMENTS 4,605,074 A * 8/1986 Barfield ..... E21B 34/063 166/297
4,928,762 A * 5/1990 Mamke ..... E21B 23/006 166/119
(Continued)

FOREIGN PATENT DOCUMENTS

WO 2014059081 A1 4/2014

OTHER PUBLICATIONS

International Search Report and Written Opinion for PCT/US2015/038636 dated Mar. 2, 2016.

*Primary Examiner* — Robert E Fuller
*Assistant Examiner* — Christopher J Sebesta
(74) *Attorney, Agent, or Firm* — McGuireWoods LLP

(57) ABSTRACT

Methods including introducing a downhole orienting tool into a wellbore comprising: a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by orienting the sensor to a reference point, and a wellbore isolation device comprising an orientation key directionally aligned with the sensor, the wellbore isolation device removably coupled to the bottom end of the mandrel and configured to rotate about the central axis with the mandrel; actively rotating the mandrel and the wellbore isolation device until the sensor is oriented to the reference point, such that the orientation key is also oriented to the reference point; and setting the wellbore isolation device in the wellbore.

20 Claims, 4 Drawing Sheets

(51) Int. Cl.

| | |
|---|---|
| ***E21B 23/06*** | (2006.01) |
| ***E21B 33/12*** | (2006.01) |
| ***E21B 47/09*** | (2012.01) |

(56) References Cited

U.S. PATENT DOCUMENTS

| | | | | |
|---|---|---|---|---|
| 5,010,964 | A | 4/1991 | Cornette | |
| 5,195,588 | A * | 3/1993 | Dave | E21B 33/13 166/264 |
| 5,329,998 | A * | 7/1994 | King | E21B 43/045 166/278 |
| 6,003,599 | A | 12/1999 | Huber et al. | |
| 6,298,915 | B1 | 10/2001 | George | |
| 2007/0144741 | A1 | 6/2007 | Cho et al. | |
| 2008/0066961 | A1* | 3/2008 | Aivalis | E21B 4/02 175/50 |
| 2008/0128132 | A1* | 6/2008 | Wilcox | E21B 43/116 166/281 |
| 2008/0264639 | A1 | 10/2008 | Parrott | |
| 2008/0314591 | A1* | 12/2008 | Hales | E21B 33/12 166/285 |
| 2009/0159297 | A1* | 6/2009 | Fould | E21B 23/04 166/385 |
| 2009/0200021 | A1 | 8/2009 | Pinto | |
| 2010/0133012 | A1 | 6/2010 | Howard | |
| 2013/0008646 | A1* | 1/2013 | Blount | E21B 43/119 166/250.01 |
| 2015/0240571 | A1* | 8/2015 | Bowles | E21B 17/04 285/351 |

* cited by examiner

ACTIVE ORIENTATION OF A REFERENCE WELLBORE ISOLATION DEVICE

BACKGROUND

The present disclosure relates generally to downhole subassembly systems and, more particularly, to an actively rotatable downhole orienting tool used to orient a wellbore isolation device to a desired circumferential location.

Hydrocarbon-producing wells often are stimulated by hydraulic fracturing operations where a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon (e.g., oil or gas) production from the well. The fracturing equipment, such as a perforating device, may be included in a stimulation assembly used in the overall production process.

In some wells, it may be desirable to create perforation tunnels within a formation using a perforating device. The perforation tunnels typically improve hydrocarbon production by further propagating and creating dominant fractures and micro-fractures so that the greatest possible quantity of hydrocarbons in an oil and/or gas reservoir can be drained/produced into the wellbore. Placement of such a perforating device, or other fracturing equipment, for use downhole typically requires anchoring a wellbore isolation device within the wellbore. The wellbore isolation device serves as a mating tool for the fracturing equipment, and may additionally serve to isolate a portion of the wellbore for treatment.

When the fracturing equipment of interest is a perforating device, perforation of the formation from a wellbore, or completion of the wellbore, may be challenging to the inability to control the orientation of such equipment. Such challenges may be exacerbated in wellbores that are horizontal or highly deviated. Correct orientation of such fracturing equipment facilitates wellbore treatment so that the wellbore can effectively produce hydrocarbons. Proper orientation may additionally be used to avoid certain obstacles in the wellbore, such as to protect other equipment in the downhole environment from abrasion or damage as a result of contact directly or indirectly with the fracturing equipment.

Traditional orienting tools are passive tools that are placed within a wellbore and set (e.g., a hanger), such that the circumferential or azimuthal orientation of the first component is unknown, such as by use of a gyroscope. The conveyance (e.g., tool string) used to set the orienting must then be removed and a directional survey performed to determine the orientation of a particular element of the orienting tool. Thereafter, the conveyance is reintroduced and the orienting tool must be physically adjusted based on the information gleaned from the directional survey. Finally, a downhole tool, such as fracturing equipment (e.g., perforating equipment), is mated to the orienting tool to ensure that the downhole tool is properly oriented within the wellbore to perform a particular operation. Accordingly, at least two trips into the wellbore are required to orient a downhole tool according to traditional methods. Additionally, associated with some traditional orienting tools is sensor technology used to confirm the orientation of the current at least two-trip orienting methodology. These traditional sensors measure only relative bearing (e.g., north-south, high-low side) of a reference point.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Figure 1:
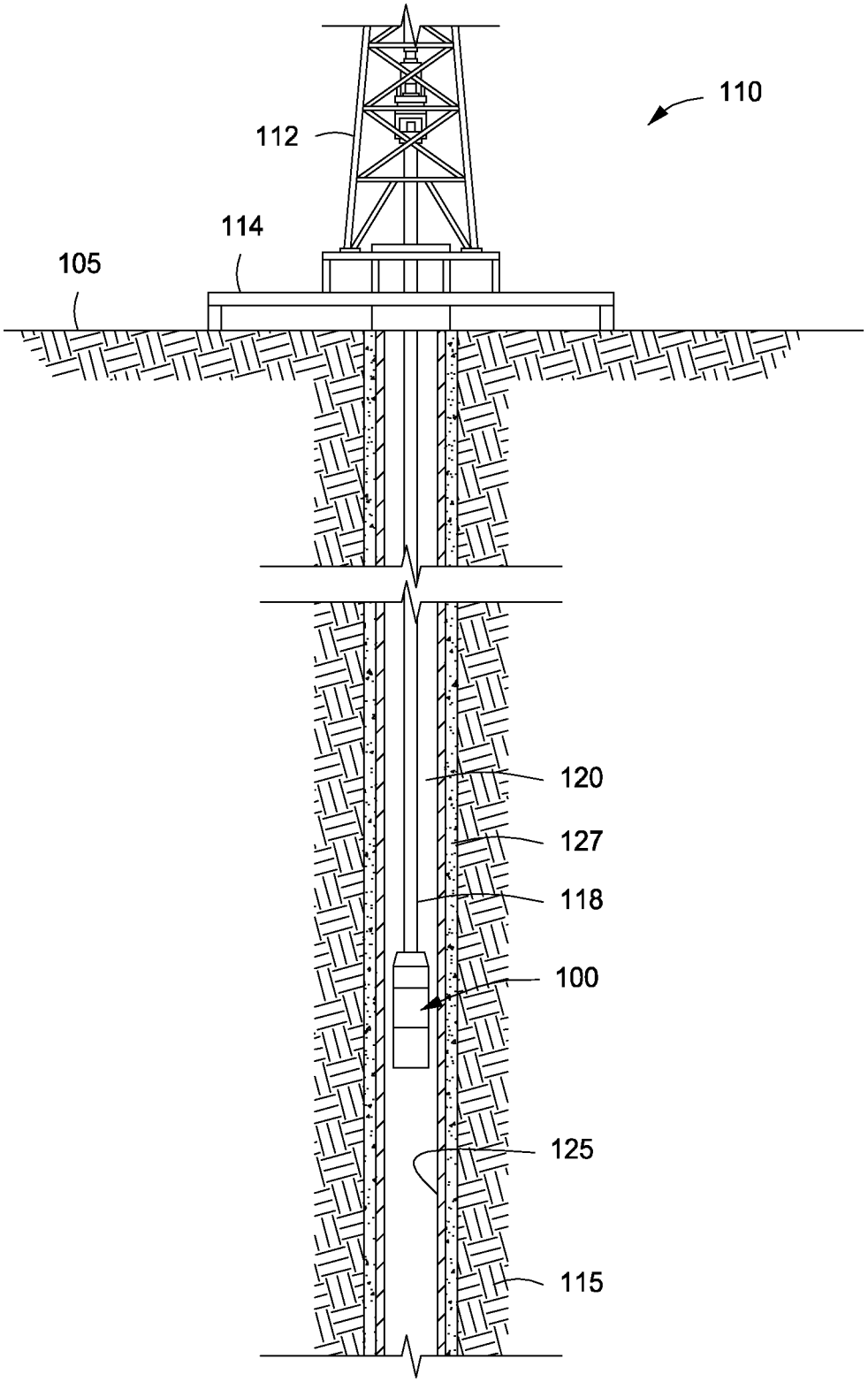
FIG. 1 illustrates a cross-sectional view of a well system comprising a downhole orienting tool, according to one or more embodiments described herein.

The present disclosure relates generally to downhole subassembly systems and, more particularly, to an actively rotatable downhole orienting tool used to orient a wellbore isolation device to a desired circumferential location.

The embodiments of the present disclosure allow single trip orienting of a wellbore isolation device to a reference point in a wellbore using an actively rotatable downhole orienting tool (also referred to simply as "orienting tool"). As used herein, the term "reference point" refers to a desired location within a wellbore that is preferably avoided during a particular downhole operation (such as a penetrating or perforating operation). The reference point may be a signal point but also may be a longitudinal (e.g., depth or length) span of a wellbore (e.g., an interval), without departing from the scope of the present disclosure. Accordingly, in some embodiments, the reference point represents a location or longitudinal span of a wellbore for penetrating a surface of the wellbore adjacent thereto or a surface of a tubing string (e.g., casing string) disposed in the wellbore. The orienting tool includes a sensor that actively rotates to sense a condition (e.g., an obstacle) in the wellbore. As used herein, the term "actively rotate" with reference to the downhole orienting tool described herein refers to rotating an assembly with regard to detecting and/or sensing in real-time a surrounding condition or obstacle and then positioning the assembly in a desired direction relative to the detected surrounding condition or obstacle. The condition may be equipment in the wellbore that one wishes to avoid when using a downhole tool oriented based on the orienting tool. For example, if the downhole tool is a penetrating tool (e.g., a tool capable of penetrating surrounding formation, either in openhole, cased, or cement cased wellbore configurations), it is necessary for the penetrating tool to avoid other downhole objects prior to performance or else damage to those objects may occur. The orienting tool is thus rotatable (e.g., by a motor) such that the sensor rotates within the wellbore until it senses a particular object downhole and then is oriented relative to that object. The orienting tool is then used to set a wellbore isolation device (resulting in an "oriented set wellbore isolation device"), which has an orientation key that lines up to a downhole tool, such that the downhole tool is also oriented within the wellbore in a desired direction relative to an object of interest (e.g., an obstacle).

Unless otherwise indicated, all numbers expressing quantities of ingredients, sizes, or any other numerical ranges used in the present specification and associated claims are to be understood as being modified in all instances by the term "about." As used herein, the term "about" encompasses +/−5% of a numerical value. Accordingly, unless indicated to the contrary, the numerical parameters set forth in the following specification and attached claims are approximations that may vary depending upon the desired properties sought to be obtained by the embodiments of the present disclosure. At the very least, and not as an attempt to limit the application of the doctrine of equivalents to the scope of the claim, each numerical parameter should at least be construed in light of the number of reported significant digits and by applying ordinary rounding techniques.

One or more illustrative embodiments are presented herein. Not all features of a physical implementation are described or shown in this application for the sake of clarity. It is understood that in the development of a physical embodiment incorporating the embodiments of the present disclosure, numerous implementation-specific decisions must be made to achieve the developer's goals, such as compliance with system-related, business-related, government-related and other constraints, which vary by implementation and from time to time. While a developer's efforts might be time-consuming, such efforts would be, nevertheless, a routine undertaking for those of ordinary skill in the art and having benefit of this disclosure.

While compositions and methods are described herein in terms of "comprising" various components or steps, the compositions and methods can also "consist essentially of" or "consist of" the various components and steps.

As used herein, the term "substantially" means largely, but not necessarily wholly.

The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Referring now to FIG. 1, illustrated is an exemplary well system 110 for a downhole orienting tool 100. As depicted, a derrick 112 with a rig floor 114 is positioned on the earth's surface 105. A wellbore 120 is positioned below the derrick 112 and the rig floor 114 and extends into subterranean formation 115. As shown, the wellbore may be lined with casing 125 that is cemented into place with cement 127. It will be appreciated that although FIG. 1 depicts the wellbore 120 having a casing 125 being cemented into place with cement 127, the wellbore 120 may be wholly or partially cased and wholly or partially cemented (i.e., the casing wholly or partially spans the wellbore and may or may not be wholly or partially cemented in place), without departing from the scope of the present disclosure. Moreover, the wellbore 120 may be an open-hole wellbore.

A conveyance 118 extends from the derrick 112 and the rig floor 114 downwardly into the wellbore 120. The conveyance 118 may be any mechanical connection to the surface, such as, for example, wireline (electric-line), slickline, jointed pipe, coiled tubing, fiber optic cable, or any combination thereof. As an example, a wireline may be used as the conveyance 118, for example, when it is desirable to receive real time data regarding the orientation of the orienting tool 100 at the surface, as discussed in greater detail below. As depicted, the conveyance 118 suspends the downhole orienting tool 100 for placement into the wellbore 120 at a desired location to perform a specific downhole operation.

It will be appreciated by one of skill in the art that the well system 110 of FIG. 1 is merely one example of a wide variety of well systems in which the principles of the present disclosure may be utilized. Accordingly, it will be appreciated that the principles of this disclosure are not necessarily limited to any of the details of the depicted well system 110, or the various components thereof, depicted in the drawings or otherwise described herein. For example, it is not necessary in keeping with the principles of this disclosure for the wellbore 120 to include a generally vertical cased section. The well system 110 may equally be employed in vertical and/or deviated wellbores, without departing from the scope of the present disclosure.

In addition, it is not necessary for the downhole orienting tool 100 to be lowered into the wellbore 120 using the derrick 112. Rather, any other type of device suitable for lowering the downhole orienting tool 100 into the wellbore 120 for placement at a desired location may be utilized without departing from the scope of the present disclosure such as, for example, mobile workover rigs, well servicing units, and the like.

Although not depicted, the structure of the downhole orienting tool 100 may take on a variety of forms to provide fluid sealing between two wellbore sections and orientation for use with a subsequent downhole tool, such as a penetrating tool. The downhole orienting tool 100, regardless of its specific structure comprises at least a mandrel, a sensor, and a wellbore isolation device.

Figure 2:
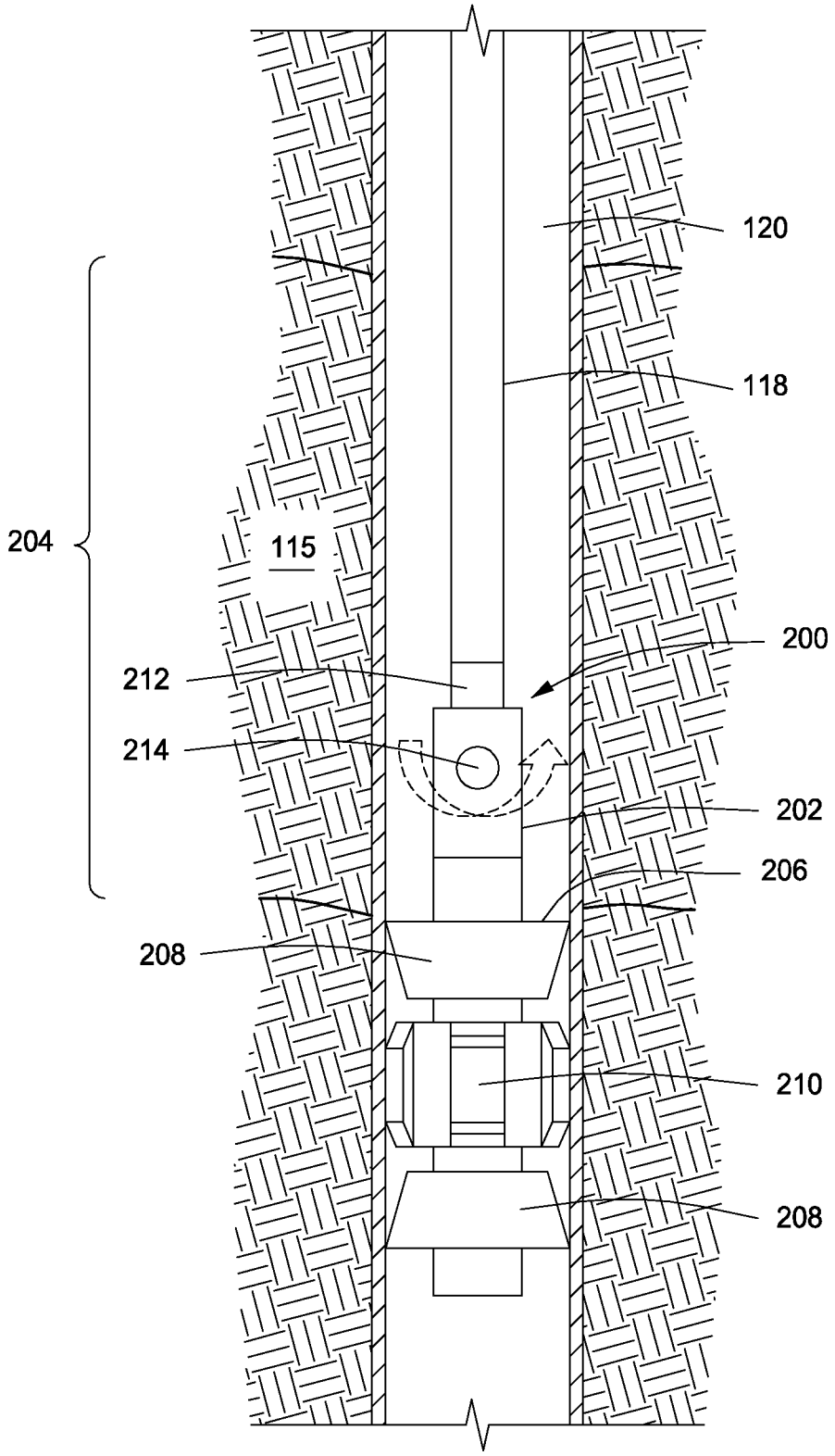
FIG. 2 illustrates a cross-sectional view of a downhole orienting tool, according to one or more embodiments of the present disclosure.

Referring now to FIG. 2, with continued reference to FIG. 1, illustrated is a downhole orienting tool 200, according to one or more embodiments of the present disclosure. As depicted, wellbore 120 extends into formation 115 from a surface 105 (FIG. 1, not shown). The downhole tool 200 comprises a mandrel 202. The mandrel 202 has a top end and a bottom end. The top end of the mandrel 200 is removably coupled to a conveyance 118 and the bottom end of the mandrel 200 is removably coupled to a wellbore isolation device 206. The wellbore isolation device 206 may be coupled to the mandrel 202 and the mandrel 202 may be coupled to the conveyance 118 by any means that permits removal. For example, the coupling may be in the form of a mechanical mechanism, a latch mechanism, a threaded mechanism (e.g., a screw), a magnetic coupling, a shearable connection (e.g., a frangible connection), and the like.

As previously discussed, the conveyance 118 may be any mechanical connection to the surface, such as, for example, wireline, slickline, fiber optic, jointed pipe, and/or coiled tubing. The wellbore isolation device forming a portion of the downhole orienting tool described herein may be any type of wellbore zonal isolation device including, but not limited to, a plug (e.g., a frac plug, a bridge plug, a packer, a wiper plug, and the like) or a packer (e.g., a compression-set packer, a hookwall packer, an inflatable packer, an openhole packer, a tension-set packer, and the like). As depicted, the wellbore isolation device 206 may be a bridge plug having seals 208 and gripping members 210 for anchoring the wellbore isolation device 206 at a location in the wellbore 120. In some instances, the downhole orienting tool 200 may be placed into the wellbore 120, such that the wellbore isolation device 206 is set in the wellbore 120 just below a target interval 204 of the formation 115. This target interval 204 may be a desired perforation interval, for example, for stimulating, injecting, and producing hydrocarbons therefrom.

The mandrel 202 of the downhole orienting tool 200 comprises a sensor module comprising a motor 212 and a sensor 214. That is, the term "sensor module," as described herein, refers to both the motor 212 and the sensor 214 disposed on or with, or integral to (collectively herein "disposed on"), the mandrel 202. As shown by the dashed arrow, the motor 212 is rotatable about a longitudinal axis, which is along the longitudinal central axis of the conveyance 118. Accordingly, the mandrel 202 is rotatable about the same longitudinal central axis. As depicted, the dashed arrow shows a clockwise rotation of the motor 212. However, it will be appreciated that the motor 212 may be rotatable circumferentially in a clockwise direction, a counter clockwise direction, or a combination of both directions such that it is freely rotatable in either direction, without departing from the scope of the present disclosure. Moreover, although the motor 212 is shown located at a top end of the mandrel 202, it will be appreciated that the motor 212 may be located at any portion of the mandrel 202 from the top end to the bottom end, provided that the motor 212 is in communication, as described below, with the sensor 214 to form the sensor module, without departing from the scope of the present disclosure.

The wellbore isolation device 206 comprises an orientation key that is directionally aligned with the sensor, as discussed in greater detail below. The wellbore isolation device 206 is removably coupled to the bottom end of the mandrel 202 and configured to rotate about the central axis along with the mandrel 202. That is, the entirety of the downhole orienting tool 200 is rotatable such that the sensor 214 and the orientation key are aligned to a reference point.

The motor 212 is in communication (e.g., electrical, mechanical, or by any other means) with the sensor 214, such that either or both of (1) the sensor 214 senses a desired reference point within the wellbore 120 which causes the motor 212 to rotate and then stop rotation such that the sensor 214 is directionally pointed to the reference point, and/or (2) the motor 214 rotates in a desired direction until the sensor 214 senses a desired reference point within the wellbore 120 and then stop rotation such that the sensor 214 is directionally pointed to a reference point. Accordingly, the sensor module as a hole is disposed on the mandrel 202 and configured to selectively interfere with the movement of the mandrel along the central axis to actively rotate the mandrel 202 by orienting the sensor 214 to a reference point, such as within the target interval 204 but positioned such that the sensor 214 is in line to avoid an obstacle therein for a subsequent operation.

The sensor 214 is configured to detect a reference point in a wellbore 120 representing a portion of the wellbore that would be undesirably disturbed, such as by use of a penetrating tool in that location, as discussed in greater detail below. For example, the reference point may be an area downhole comprising a tubing string, a cable, a control line, an optical fiber, a water table, or any other equipment, machinery, or naturally occurring obstacle. Accordingly, in some embodiments, the sensor 214 may be used to locate an area that is not to be disturbed, rather than one that is desirably disturbed. The sensor 214, in other embodiments, may be configured to detect a particular reference point that has been placed within the wellbore 120 (e.g., placed within a particular piece of equipment or machinery) and designed to ensure orientation of the downhole orienting tool 200 within the wellbore 120. For example, the reference point may be a magnet, a type or amount of metal compared to surrounding equipment, a radioactive signal, an optical signal, an acoustic signal, a sonic signal, a radio frequency signal, a thermal signal, an electrical current signal, an electrical potential signal, a vibratory signal, a pressure signal, and combinations thereof.

Other reference point signals may also be appropriate. Additionally, one or more of these signals may be natural to the equipment type or wellbore 120 environment such that an additional reference point need not be specifically included. For example, areas in which a second tubing string (e.g., casing string) may be contacted by a penetrating tool, the amount of metal detected by a sensor 214 may be elevated where the second tubing exists, thereby allowing the downhole orienting tool 200 to rotate and align the sensor 214 with the second tubing and permitting avoidance of that area with the penetrating tool. As another example, the embodiments described herein permit setting of the wellbore isolation device 206 in a relatively short tubing string and orient the wellbore isolation device 206 away from a long tubing string, such that subsequent operations are directionally aligned based on the orientation of the wellbore isolation device 206, discussed in greater detail below, away from the long tubing string.

The sensor 214 may be any sensor type that is capable of identifying an obstacle within a wellbore 120. Such sensor types may include, but are not limited to, a radioactive sensor, an optical sensor, an acoustic sensor, a sonic sensor, a metal concentration sensor, a metal type sensor (i.e., a sensor that identifies a particular type or types of metal), a magnetic sensor, an electrical current sensor, a radio frequency identification (RFID) sensor, a vibratory sensor, an electrical potential sensor, a pressure sensor, and any combination thereof. That is, the sensor 214 may be configured to detect one or more types of signals to locate the reference point.

For example, the sensor 214 may be configured as a magnetic sensor, comprising an exciter coil, a reference coil, and a sensor coil. The exciter coil is energized from the surface 105 (FIG. 1). Without being limited, as an example, the exciter coil may be energized at 120 alternating current (AC), 150 milliamperes (mA), at frequency of 60 hertz (Hz). The exciter coil is energized to produce a uniform alternating magnetic field in all directions from the sensor 214. For instance, in the example above, the exciter coil may produce a uniform alternating magnetic field in all directions from the sensor 214 of about 3 meters (equivalent to about 10 feet). When the downhole orienting tool 200 is placed into a wellbore 120 having dual tubing string (i.e., overlapping pipe) and the location of the dual tubing string is the desired reference point, as discussed previously, the magnetic field penetrates the tubing string and returns to the reference and sensor coils. If the second tubing string is not encountered, only the reference coil will measure voltage, whereas the sensor coil will experience no voltage change. When the second tubing is encountered, the sensor coil experiences a voltage change proportional to the direction of the second tubing string. The voltage change is caused by an eddy current on the tubing string surface near the sensor coil of the sensor 214. The downhole tool 200 is rotated circumferentially about its central axis until a maximum reading from the sensor coil is obtained, after which rotation is stopped so that the mandrel 202 and the wellbore isolation device 206 of the downhole orienting tool 200 are positioned to be directionally aligned with the reference point. As will be appreciated, the voltage opposite the reference point experienced by the sensor coil of the sensor 214 will be minimum at a direction opposite to the second tubing string. Thereafter, the wellbore isolation device 206 is set and the orientation key (see FIG. 3) of the wellbore isolation device 206 is directionally oriented with reference to the reference point.

In some embodiments, the conveyance 118 is a wireline and real time data regarding the circumferential direction of the sensor 214 within the wellbore 120, the circumferential direction of the orientation key 216 within the wellbore 120, or the type of reference point detected by the sensor 214. In other embodiments, the wireline may be capable of controlling operations remotely, without departing from the scope of the present disclosure. However, because the embodiments of the present disclosure employ active rotation of a downhole orienting tool 200 to a reference point, a wireline capable of receiving and transmitting data to the surface is not required in order to perform a subsequent operation designed to avoid a particular area within the wellbore 120 represented by the reference point.

Figure 3:
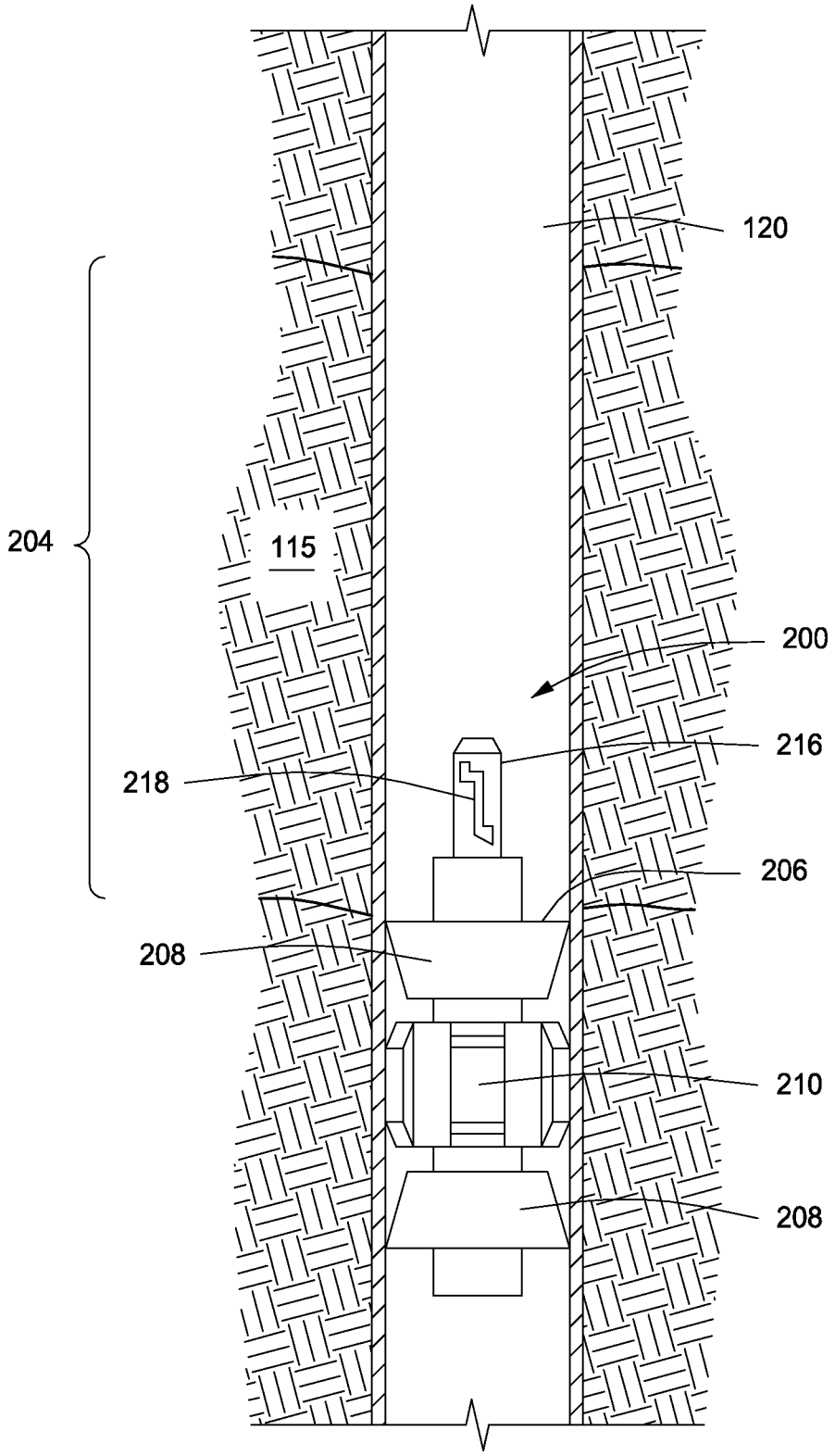
FIG. 3 illustrates a cross-sectional view of a wellbore isolation device forming a portion of a downhole orienting tool, according to one or more embodiments of the present disclosure.

Referring now to FIG. 3, with continued reference to FIG. 2, illustrated is the wellbore isolation device 206 from the downhole orienting tool 200 in FIG. 2. The downhole orienting tool 200 has rotated about the central axis and the sensor 214 oriented to a reference point. Thereafter, the wellbore isolation device has been set within the wellbore 120 and the removably coupled mandrel 202 decoupled from the wellbore isolation device 206 and removed from the wellbore 120. The orientation key 216 is also aligned with the reference point because the sensor 214 and the orientation key 216 are directionally aligned, thus the orientation key 216 rotates with the sensor 214 until rotation is ceased due to alignment with the reference point. As used herein, the term "directionally aligned" with reference to the sensor 214 and the orientation key 216 means that each are oriented in a known direction with reference to one another. For example, the sensor 214 and the orientation key 216 may be aligned in the same direction such that the sensor 214 and the orientation key 216 are pointed simultaneously toward the reference point. In other embodiments, the sensor 214 and the orientation key 216 are pointed in opposite directions, such that the sensor 214 is pointed toward the reference point and the orientation key 216 is pointed about 180° circumferentially away from the reference point. Any angular deviation therebetween may additionally be suitable provided that the desired operation to be performed thereafter does not interfere with the reference point or obstacle to be avoided. For example, the orientation key may be circumferentially oriented in the range of about 20° to about 340° from the direction of the sensor 214, without departing from the scope of the present disclosure.

The orientation key 216, as shown, may have a particular engaging profile 218 with a known directional alignment relative to the sensor 214 (FIG. 2). The engaging profile of the orientation key 216 serves as a mating component for receiving a subsequent downhole tool. Because the circumferential direction of the orientation key 216 is known, at least relative to a reference point that is to be avoided, the direction of the subsequent downhole tool is also known that is mated with the engaging profile 218 of the orientation key 216. Accordingly, the directional alignment of the sensor 214 and the orientation key 216 is designed to ensure that the particular subsequent downhole tool is oriented to perform an action away from the reference point, which is to be avoided.

As shown, the orientation key 216 is substantially cylindrical in shape and comprises an engaging profile 218 that is substantially L-shaped. However, the shape of the orientation key 216 and engaging profile 218 thereof may be any shape suitable for mating a subsequent downhole tool. Moreover, the shape and engaging profiled 218 of the orientation key 216 may differ specifically depending on the type of subsequent downhole tool and operation to be performed. That is, the shape of the orientation key 216 may be square-shaped, polygonal-shaped, spherical-shaped, L-shaped, cuboidal-shaped, rectangular-shaped, conical-shaped, triangular-shaped, irregular-shaped, and the like, without departing from the scope of the present disclosure. Similarly, the engaging profile 218 may be any shape designed to orient a subsequent downhole tool in accordance with the orientation of the orientation key 216. Such engaging profiles may be square-shaped, polygonal-shaped, spherical-shaped, L-shaped, cuboidal-shaped, rectangular-shaped, conical-shaped, triangular-shaped, irregular-shaped, cylindrical-shaped, and the like. Moreover, the shape of the orientation key 216 itself may be used to mate a subsequent downhole tool and the engaging profile 218 may not be necessary, without departing from the scope of the present disclosure. In other embodiments, the orientation key 216 may be contoured or angled (as is the tip of the orientation key 216 in FIG. 3) and serve as a stinger for guiding a subsequent downhole tool.

Figure 4:
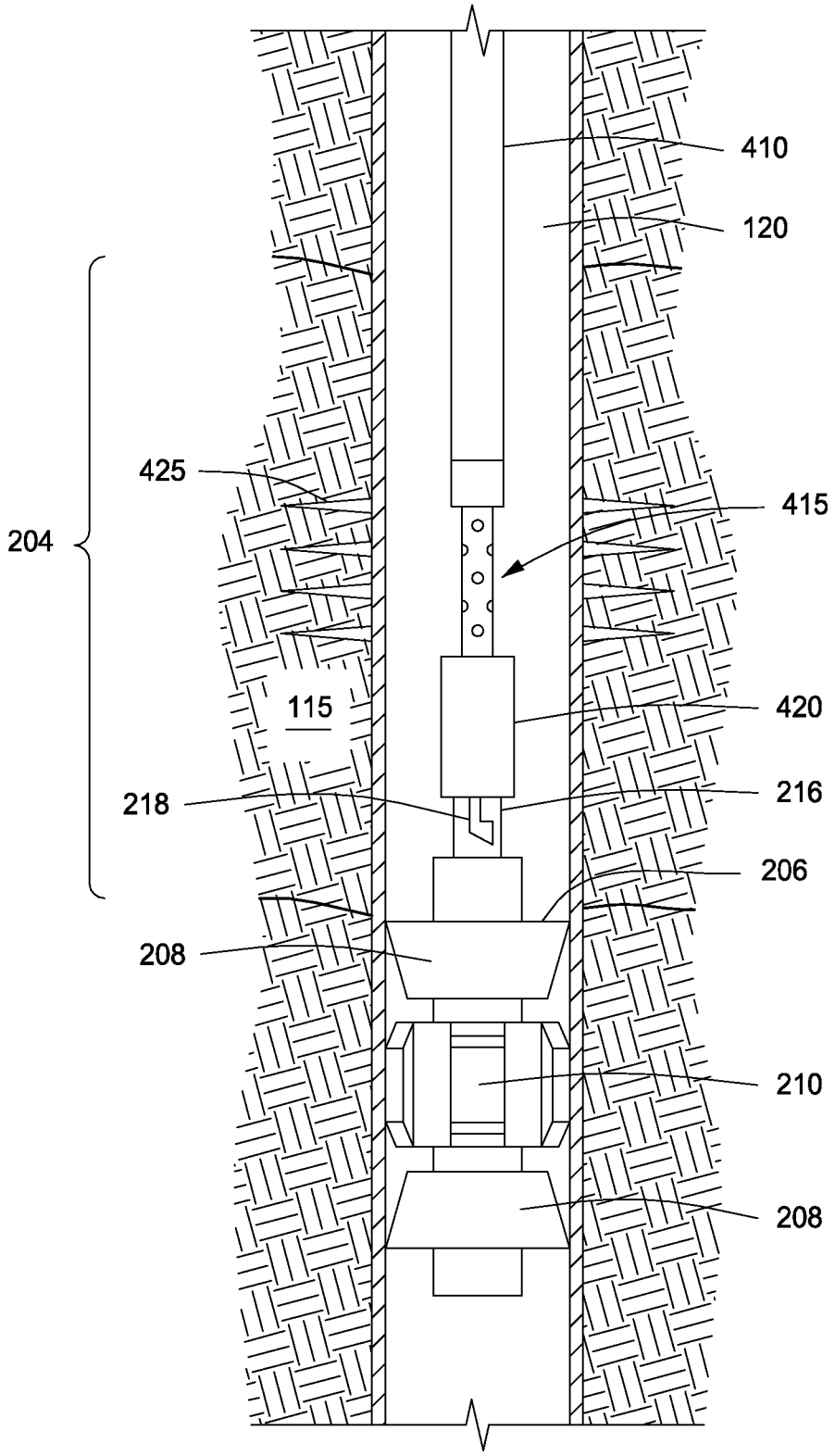
FIG. 4 illustrates a cross-sectional view of a wellbore isolation device forming a portion of a downhole orienting tool mated to a penetrating tool, according to one or more embodiments described herein.

Referring now to FIG. 4, with continued reference to FIG. 2 and FIG. 3, illustrated is a subsequent operation being performed after the wellbore isolation device 210 is oriented and set, as described above, resulting in an oriented wellbore isolation device 206. The mandrel 202 (FIG. 2) of the downhole orienting tool 200 (FIG. 2) has been removably decoupled from the wellbore isolation device 206 and removed from the wellbore 120. Thereafter, a subsequent downhole tool is introduced into the wellbore 120 on a conveyance 410, which may be substantially the same as the conveyance 118 of FIG. 1 and FIG. 2, but need not be the same. As depicted, the conveyance 410 is operably connected to a penetrating tool, shown as perforating tool 415. Although the penetrating tool is shown as a perforating tool 415, it will be appreciated that any type of subsequent downhole tool may be used in accordance with the embodiments described herein to perform an operation in a known direction. Examples of suitable penetrating tools include any downhole tool capable of abrading or otherwise penetrating the subterranean formation 115 in an openhole or cased (or cased and cemented) wellbore 120. Such penetrating tools may include, but are not limited to, a perforating tool, including a modular perforating tool, a cutting tool, or a punching tool. Accordingly, although a perforating tool 415 is referred to with reference to FIG. 4, the term may be exchanged for any penetrating tool, without departing from the scope of the present disclosure.

As shown, the perforating tool 415 is aligned with the orientation key 216 of the oriented set wellbore isolation device with a coupling 420 capable of mating to the orientation key 216 and thus directionally aligning the perforating tool 415 within the circumference of the wellbore 120. The coupling 420, although depicted as substantially cylindrical, may be any size and shape suitable for mating with the orientation key 216. The coupling 420 may be an alignment skirt, for example, that is fabricated with a slot for receiving the orientation key 216.

Additionally, although a single perforating tool 415 is depicted, a plurality of perforating tools 415 (or penetrating tools) may be stacked upon one another and aligned simultaneously using the orientation key 216, without departing from the scope of the present disclosure. The alignment with the orientation key 216 of a plurality of stacked perforating tools 415 (or penetrating tools generally) may be by first connecting the plurality of perforating tools 415 prior to their introduction into the wellbore 120, where the bottom most perforating tool 415 has a coupling 420 for orienting all of the perforating tools 420 with the orientation key 216 simultaneously. In other embodiments, the perforating tools 420 themselves may have orientation keys that mate with a coupling of an upper perforating tool 420, without departing from the scope of the present disclosure.

Indeed, the ability to orient one or multiple perforating tools 420 (or penetrating tools) advantageously allows maximization of underbalanced perforating (or penetrating), which occurs when the pressure in the wellbore 420 is lower than the pressure of the formation. The level of pressure differential is important to create open, undamaged perforations and optimize well productivity. The pressure differential causes fluid flow into the wellbore, which helps to remove any perforation and crushed formation debris that might otherwise create damage. However, traditional techniques requiring the two-trip orienting methodology often limited the ability to maximize underbalanced perforating techniques, which could result in a perforation tunnel with tunnel plugging due to crushed formation material and charge debris. Accordingly, the embodiments of the present disclosure beneficially reduce costs, reduce or eliminate the need for perforating tool 415 brake (anchor) systems, reduce or eliminate the need to perform equalizing shots, perforate (or penetrate) an entire desired interval, and reduce time to production. Moreover, the embodiments herein are compatible with existing technologies and equipment adapted according to the embodiments in the present disclosure including, but not limited to, existing wellbore Such directional alignment of the sensor 214 and the orientation key 216 may vary because the location of a subsequent operation, such as use of a penetrating tool 415 may be desirably opposite a reference point or along some other circumferential angle relative to the reference point. Referring again to FIG. 4, the perforating tool 415 is mated to the orientation key 216 by way of the engaging profile 218 such that the perforations are directionally aligned away from a reference point in the target interval 204. Thereafter, the perforating tool 415 is detonated and perforation tunnels 425 are formed in the subterranean formation 425 at some circumferential distance away from the reference point (i.e., obstacle to be avoided).

Embodiments disclosed herein include:

Embodiment A

A method comprising: introducing a downhole orienting tool into a wellbore, the downhole tool comprising: a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by orienting the sensor to a reference point, and a wellbore isolation device comprising an orientation key directionally aligned with the sensor, the wellbore isolation device removably coupled to the bottom end of the mandrel and configured to rotate about the central axis with the mandrel; actively rotating the mandrel and the wellbore isolation device until the sensor is oriented to the reference point, such that the orientation key is also oriented to the reference point; and setting the wellbore isolation device in the wellbore, thereby resulting in an oriented set wellbore isolation device.

Embodiment B

A system comprising: a conveyance connected to a derrick and extending through a surface into a wellbore; and a downhole orienting tool connected to the conveyance and placed in the wellbore, the downhole orienting tool comprising: a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by orienting the sensor to a reference point, and a wellbore isolation device comprising an orientation key directionally aligned with the sensor, the wellbore isolation device removably coupled to the bottom end of the mandrel and configured to rotate about the central axis with the mandrel.

Embodiment C

A downhole orienting tool comprising: a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by orienting the sensor to a reference point, and a wellbore isolation device comprising an orientation key directionally aligned with the sensor, the wellbore isolation device removably coupled to the bottom end of the mandrel and configured to rotate about the central axis with the mandrel.

Each of embodiments A, B, and C may have one or more of the following additional elements in any combination:

Element 1: Further comprising decoupling the mandrel from the set wellbore isolation device.

Element 2: Further comprising: decoupling the mandrel from the set wellbore isolation device; removing the mandrel from the wellbore; introducing a penetrating tool into the wellbore; and aligning the penetrating tool with the orientation key of the oriented set wellbore isolation device.

Element 3: Further comprising: decoupling the mandrel from the set wellbore isolation device; removing the mandrel from the wellbore; introducing a penetrating tool into the wellbore; and aligning the penetrating tool with the orientation key of the oriented set wellbore isolation device, wherein the penetrating tool is a perforating tool, a cutting tool, or a punching tool.

Element 4: Further comprising: decoupling the mandrel from the set wellbore isolation device; removing the mandrel from the wellbore; introducing a plurality of penetrating tools into the wellbore; and aligning the plurality of penetrating tools with the orientation key of the oriented set wellbore isolation device.

Element 5: Further comprising: decoupling the mandrel from the set wellbore isolation device; removing the mandrel from the wellbore; introducing a plurality of penetrating tools into the wellbore; and aligning the plurality of penetrating tools with the orientation key of the oriented set wellbore isolation device, wherein the penetrating tool is a perforating tool, a cutting tool, or a punching tool.

Element 6: Wherein the reference point represents a location for penetrating an adjacent surface of the wellbore or of a tubing string disposed in the wellbore.

Element 7: Wherein wellbore isolation device is a plug or a packer.

Element 8: Wherein the sensor is selected from the group consisting of a radioactive sensor, an optical sensor, an acoustic sensor, a sonic sensor, a metal concentration sensor, a metal type sensor, a magnetic sensor, an electrical current sensor, a radio frequency identification sensor, a vibratory sensor, an electrical potential sensor, a pressure sensor, and any combination thereof.

Element 9: Wherein the downhole orienting tool is introduced into the wellbore on a conveyance.

Element 10: Wherein the downhole orienting tool is introduced into the wellbore on a conveyance, and the conveyance is a wireline.

Element 11: Wherein the downhole orienting tool is introduced into the wellbore on a conveyance, and the conveyance is a wireline, and wherein a signal from the sensor is communicated to a surface through the wireline, the signal corresponding to a circumferential direction of the orientation key of the oriented set wellbore isolation device.

By way of non-limiting example, exemplary combinations applicable to A, B, C include: 1, 4, and 11; 1, 2, 3, 4, 5, 6, 7, 8, 9, 10, and 11; 3, 5, and 9; 2, 5, 7, 8, and 10; 1, 4, and 7; 6, 7, and 9; 2, 3, 5, 6, and 10; 8 and 9; 4 and 6; and the like.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The embodiments illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

What is claimed is:

1. A method comprising:

introducing a downhole orienting tool into a wellbore, the downhole orienting tool comprising:

a mandrel having a top end and a bottom end, and rotatable about a longitudinal central axis, a sensor module comprising a motor and a sensor, the sensor module disposed on the mandrel, and a wellbore isolation device comprising an orientation key directionally aligned with the sensor, the orientation key forming a profile on a partial outer circumference of the wellbore isolation device, the partial outer circumference being less than a 360° arc around the wellbore isolation device, the profile being radially asymmetric about the longitudinal central axis, the wellbore isolation device removably coupled to the bottom end of the mandrel and configured to rotate about the central axis with the mandrel;

detecting, with the sensor, an obstacle behind a casing in the wellbore;

actively rotating the mandrel and the wellbore isolation device until the sensor is oriented away from the obstacle and to a reference point, such that the orientation key is also rotationally oriented to the reference point; and after actively rotating the mandrel and the wellbore isolation device, setting the wellbore isolation device in the wellbore, thereby resulting in an oriented set wellbore isolation device;

introducing a penetrating tool into the wellbore;

aligning the penetrating tool with the orientation key of the oriented set wellbore isolation device;

coupling the penetrating tool to the wellbore isolation device; and activating the penetrating tool while the penetrating tool is coupled to the wellbore isolation device.

2. The method of claim 1, further comprising decoupling the mandrel from the set wellbore isolation device.

3. The method of claim 1, further comprising:

decoupling the mandrel from the set wellbore isolation device; and removing the mandrel from the wellbore.

4. The method of claim 1, wherein the penetrating tool is a perforating tool, a cutting tool, or a punching tool.

5. The method of claim 1, further comprising:

decoupling the mandrel from the set wellbore isolation device;

removing the mandrel from the wellbore;

introducing a plurality of penetrating tools into the wellbore; and aligning the plurality of penetrating tools with the orientation key of the oriented set wellbore isolation device.

6. The method of claim 5, wherein the penetrating tool is a perforating tool, a cutting tool, or a punching tool.

7. The method of claim 1, wherein the reference point represents a location for penetrating an adjacent surface of the wellbore or of a tubing string disposed in the wellbore.

8. The method of claim 1, wherein wellbore isolation device is a plug or a packer.

9. The method of claim 1, wherein the sensor is selected from the group consisting of a radioactive sensor, an optical sensor, an acoustic sensor, a sonic sensor, a metal concentration sensor, a metal type sensor, a magnetic sensor, an electrical current sensor, a radio frequency identification sensor, a vibratory sensor, an electrical potential sensor, a pressure sensor, and any combination thereof.

10. The method of claim 1, wherein the downhole orienting tool is introduced into the wellbore on a conveyance.

11. The method of claim 10, wherein the conveyance is a wireline.

12. The method of claim 11, wherein a signal from the sensor is communicated to a surface through the wireline, the signal corresponding to a circumferential direction of the orientation key of the oriented set wellbore isolation device.

13. A system comprising:

a conveyance connected to a derrick and extending through a surface into a wellbore; and downhole orienting tool connected to the conveyance and placed in the wellbore, the downhole orienting tool comprising:

a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by rotationally orienting the sensor to a reference point about the longitudinal central axis, and a wellbore isolation device comprising an orientation key aligned with the sensor on a side of the longitudinal central axis to form a radially asymmetric profile on a partial outer circumference of the wellbore isolation device, the partial outer circumference being less than a 360° arc around the wellbore isolation device, the radially asymmetric profile being radially asymmetric about the longitudinal central axis, the wellbore isolation device removably coupled to the bottom end of the mandrel and configured to rotate about the central axis with the mandrel, wherein the downhole orienting tool is configured to detect, with the sensor, an obstacle behind a casing in the wellbore; and a penetrating tool that is aligned with the orientation key of the wellbore isolation device, wherein the penetrating tool is coupled to the wellbore isolation device, and wherein the penetrating tool is configured to be activated while the penetrating tool is coupled to the wellbore isolation device.

14. The system of claim 13, wherein the reference point represents a location for penetrating an adjacent surface of the wellbore or of a tubing string disposed in the wellbore.

15. The system of claim 13, wherein wellbore isolation device is a plug or a packer.

16. The system of claim 13, wherein the sensor is selected from the group consisting of a radioactive sensor, an optical sensor, an acoustic sensor, a sonic sensor, a metal concentration sensor, a metal type sensor, a magnetic sensor, an electrical current sensor, a radio frequency identification sensor, a vibratory sensor, an electrical potential sensor, a pressure sensor, and any combination thereof.

17. A downhole orienting tool comprising:

a mandrel having a top end and a bottom end, and rotatable about a longitudinal central axis, a sensor module comprising a motor and a sensor, the sensor module disposed on the mandrel and configured to selectively interfere with the movement of the mandrel along the central axis and actively rotate the mandrel by rotationally orienting the sensor to a reference point about the longitudinal central axis, and a wellbore isolation device comprising an orientation key aligned with the sensor on a side of the longitudinal central axis to form a radially asymmetric profile on a partial outer circumference of the wellbore isolation device, the partial outer circumference being less than a 360° arc around the wellbore isolation device, the radially asymmetric profile being radially asymmetric about the longitudinal central axis, the wellbore isolation device removably coupled to the bottom end of the mandrel and configured to rotate about the central axis with the mandrel, wherein the wellbore isolation device is configured to detect, with the sensor, an obstacle behind a casing in the wellbore; and a penetrating tool that is aligned with the orientation key of the we bore isolation device, wherein the penetrating tool is coupled to the wellbore isolation device, and wherein the penetrating tool is configured to be activated while the penetrating tool is coupled to the wellbore isolation device.

18. The downhole orienting tool of claim 17, wherein the reference point represents a location for penetrating an adjacent surface of a wellbore or of a tubing string disposed in the wellbore.

19. The downhole orienting tool of claim 17, wherein the wellbore isolation device is a plug or a packer.

20. The system downhole orienting tool of claim 17, wherein the sensor is selected from the group consisting of a radioactive sensor, an optical sensor, an acoustic sensor, a sonic sensor, a metal concentration sensor, a metal type sensor, a magnetic sensor, an electrical current sensor, a radio frequency identification sensor, a vibratory sensor, an electrical potential sensor, a pressure sensor, and any combination thereof.

* * * * *